United States Patent [19]

Petitjean

[11] Patent Number: 4,515,368

[45] Date of Patent: May 7, 1985

[54] GOLF CLUB SWING TRAINING DEVICE

[76] Inventor: Donald L. Petitjean, 217 Cardinal Dr., Bloomingdale, Ill. 60108

[21] Appl. No.: 469,964

[22] Filed: Feb. 25, 1983

[51] Int. Cl.[3] ..... A63B 69/36

[52] U.S. Cl. ..... 273/186 A; 273/194 R

[58] Field of Search ..... 273/194 R, 186 A, 186 C, 273/194 A, 194 B, 186 R, 183 D

[56] References Cited

U.S. PATENT DOCUMENTS

| | | | |
|---|---|---|---|
| 1,549,350 | 8/1925 | Deike | 273/186 A |
| 1,676,270 | 7/1928 | Mattison | 273/186 A |
| 2,135,648 | 11/1938 | Stumpf | 273/186 A |
| 2,158,211 | 5/1939 | Aitken | 273/186 A |
| 2,203,893 | 6/1940 | Chapman | 273/186 A |
| 2,214,356 | 9/1940 | Wettlaufer | 273/186 A |
| 2,218,943 | 10/1940 | Whitney | 273/194 R X |
| 2,396,408 | 3/1946 | Benecke | 273/186 A |
| 2,543,722 | 2/1951 | Hetzel | 273/186 A |
| 2,787,470 | 4/1957 | Barrus et al. | 273/186 A |
| 2,950,115 | 8/1960 | Hurdzan | 273/186 A |
| 3,070,373 | 12/1962 | Mathews et al. | 273/186 A |
| 3,106,403 | 10/1963 | Kirkman | 273/186 A |
| 3,113,781 | 12/1963 | Guier | 273/186 A |
| 3,113,782 | 12/1963 | Guier | 273/186 A |
| 3,172,668 | 3/1965 | Blake | 273/186 A |
| 3,215,437 | 11/1965 | Webb | 273/186 A |
| 3,226,704 | 12/1965 | Petrash | 273/186 A |
| 3,254,895 | 6/1966 | Haas | 273/186 A |
| 3,498,616 | 3/1970 | Hurst | 273/186 A |
| 3,561,272 | 2/1971 | Davis | 273/186 A |
| 3,848,873 | 11/1974 | Linning | 273/186 A |
| 4,270,753 | 6/1981 | Maroth et al. | 273/186 A |

*Primary Examiner*—George J. Marlo

*Attorney, Agent, or Firm*—Leydig, Voit, Osann, Mayer & Holt, Ltd.

[57] ABSTRACT

A device for improving the mechanics of a golfer's swing which is attached to the golf club and adjacent to the grip, and which emits a continuous audible signal so long as the device is subjected to at least a predetermined centrifugal force which is generated by swinging the club. The device includes a battery, buzzer and switch which is spring biased to force the switch open. The spring is compressed by the centrifugal force generated by swinging the club to allow the switch to close and activate the buzzer. The spring may be adjustably prestressed to vary the amount of centrifugal force needed to close the switch.

3 Claims, 4 Drawing Figures

GOLF CLUB SWING TRAINING DEVICE

BACKGROUND OF THE INVENTION

This invention pertains to a device for improving the timing of a golf club swing so that the distance traveled by a golf ball may be increased. The device is preferably attached to the golf club at such a point so that the device has a negligible effect on the swing weight or dynamic characteristics of the golf club. The device responds to the centrifugal force resulting from the golf club swing to give a continuous audible sound as long as a pre-selected threshold speed, or a speed greater than the threshold, is achieved and maintained.

Prior art devices used to improve a golfer's swing generally change to a significant degree the swing weight of the golf club when attached to the club. Also, many prior art devices are placed near or on the head of the golf club. Because the lengths of golf clubs vary within a set, the club head speed varies from club to club for a swing of a constant angular velocity. Thus devices which depend on the club head speed do not tell a golfer whether he is swinging all the golf clubs in his set at the same rate in terms of body movement or hand speed.

Further, various prior art devices have been designed to respond to the club speed resulting from the golf swing, and some of them also emit audible sounds when a certain swing speed is achieved. However, the sound is either only momentary, and not sustained, even though the desired swing speed may be maintained, or continuous throughout the club swing and varying in loudness in relation to the club speed. Since these types of devices give instantaneous or constantly varying indications of club speed, golfers have found it difficult to discern the point in the swing at which the desired speed is reached and maintained.

BRIEF SUMMARY OF THE INVENTION

In a proper golf swing, the golfer wishes to time his swing so that the greatest club head velocity is reached when striking the ball, with that speed maintained into the follow-through. Additionally, the golfer desires to swing all clubs with the same rate of body movement. This invention provides a device for improving the timing of a golf club swing. The device attaches to the golf club on the shaft and grip of the club a short distance below the grip, thus having no significant effect on the swing weight of the golf club. The device is attached securely to the shaft so that it does not slide down the shaft of the golf club during the swing of the club, but may be removed from one club and attached to any one of several other golf clubs within a set. Because the distance the device is attached from the grip varies insignificantly, the device promotes consistent swing mechanics regardless of the club used. The device emits a continuous audible sound as long as the swing generates at least a preselected minimum centrifugal force corresponding to the maximum desired speed of the club during the swing.

Thus, it is an object of the present invention to provide a device for improving the timing of a golf club swing in which the device does not significantly effect the dynamic characteristics of the golf club so that skills developed by practicing with the device are easily transferable to actual playing situations.

It is another object of the invention to provide such a device which will indicate to the golfer when a certain minimum swing speed has been attained and to continue to provide that indication as long as that speed is maintained or exceeded.

It is a further object to provide such a device which can be easily utilized with any club within a set and provide an indication of the swing speed not dependent on the club length.

Additional objects and features of the invention will be apparent from the following description in which the preferred embodiments are set forth in detail in conjunction with the accompanying drawings.

DESCRIPTION OF THE PREFERRED EMBODIMENTS

Figure 1:
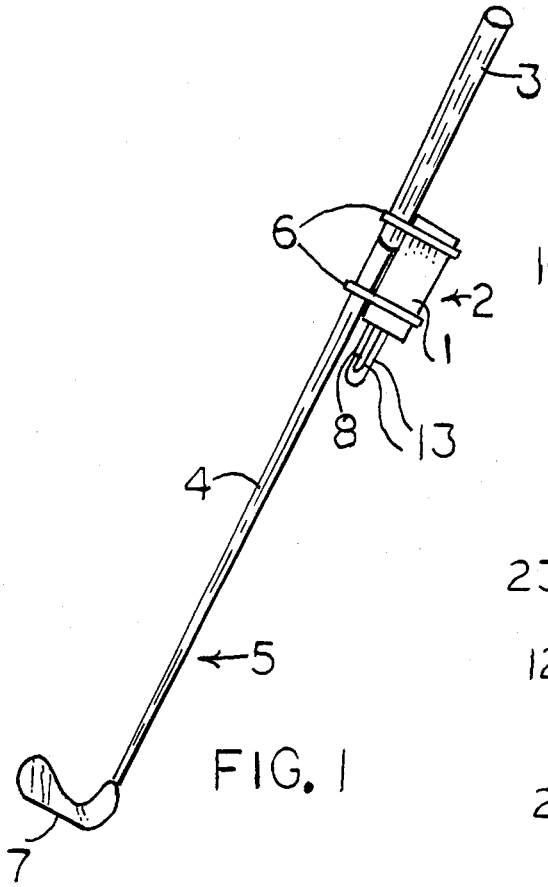
FIG. 1 is a perspective view of the golf club with the device for improving the timing of a golf club swing attached.

While the invention is susceptible to various modifications and alternative constructions, illustrative embodiments have been shown in the drawings and will be described below in detail. It should be understood, however, that there is no intention to limit the invention to the specific form described, but on the contrary, the intention is to cover all modifications, alternative constructions, and equivalents falling within the scope of the appended claims.

Turning to FIG. 1, a housing 1 of a device 2 is attached to a golf club 5 near the bottom of the grip 3 and on the shaft 4 by two straps 6. The device 2 is located on the shaft 4 at a point which rests on the fulcrum point of a swing weight machine when the club 5 is held in the swing weight machine. Locating the device on the club as close as possible to this point minimizes any effect the device has on the swing weight of the club and ensures that the skills developed by practicing with the device are readily duplicated when using the golf club with the device removed. The straps 6 prevent the device 2 from moving along the shaft 4 toward the head 7 of the golf club 5 due to the centrifugal force generated parallel to the shaft 4 when the golf club 5 is swung by the golfer. The straps 6 also allow the device to be removed and secured to any of the other clubs within the set.

The device 2 is provided with a slidable member 8 which can be set at various depths of insertion in the housing 1 of the device 2. The minimum swing speed required for the device 2 to emit an audible signal is determined by the depth of insertion of the slidable member 8 into the housing 1 of the device 2. Thus the device can be used by different golfers who would not swing their clubs at the same speed, or by a single golfer who, as he improves, desires to swing his clubs at higher speeds.

Figure 2:
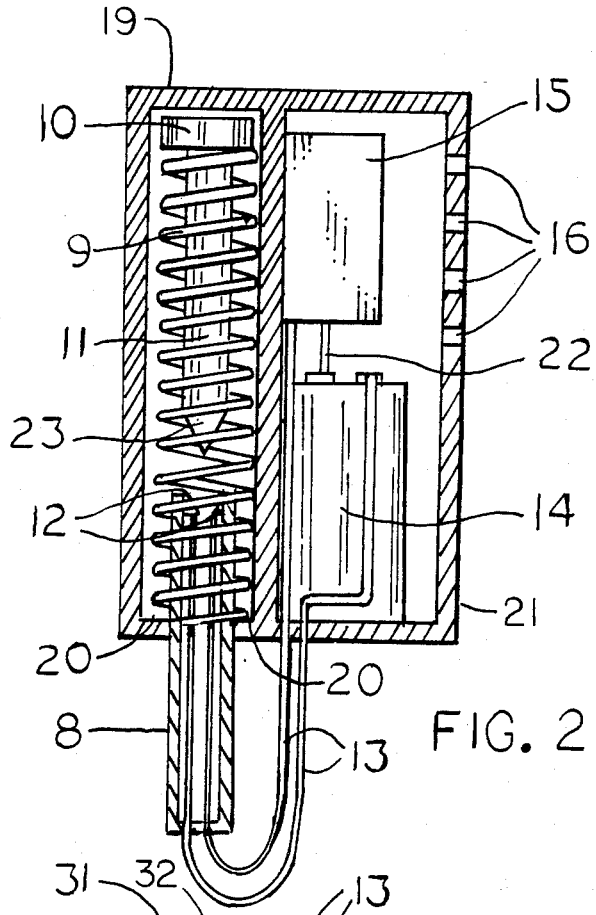
FIG. 2 is a vertical sectional view of one version of the device.

As shown in FIG. 2, a first section 19 of the housing 1 holds a helical spring or other resilient means 9 which extends from the inside edge 20 of the first section 19 to the underside of cap 10 integral with rod or plunger 11, the spring 9 thus encircling the rod 11. The end 23 of the rod 11 is electrically conductive.

Figure 3:
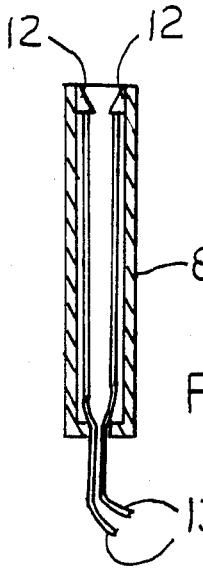
FIG. 3 is a sectional view of the slidable member for the device version of FIG. 2.

As best seen in FIG. 3, at the end of the slidable member 8 within the housing 1, the slidable member 8 holds two metal strips 12 adjacent to, but not in contact with, one another. An insulated wire 13 is connected to each of the two metal strips 12. Each insulated wire 13 enters a second section 21 of the housing 1, with one of the wires 13 being connected to a buzzer 15 or any other electrically-activated device which emits a continuous audible signal, while the other wire 13 is connected to one side of a power source such as a battery 14. Another wire 22 connects the opposite sides of the battery 14 and the buzzer 15. The buzzer 15, battery 14, and metal strips 12 are thus connected in series. The second section 21 of the housing 1 is provided with multiple openings 16 which allow the sound of the buzzer 15 to be heard clearly by the golfer.

When the golf club 5 is swung by a golfer, the rod 11 is subjected to the radial acceleration generated by the swing, thus compressing spring 9. If the centrifugal force exerted on the rod 11 due to its radial acceleration is great enough, the conductive end 23 of rod 11 will contact metal strips 12, thus acting as a switch and completing the circuit between the battery 14 and buzzer 15, and energizing the buzzer 15. The buzzer 15 will remain energized as long as the swing speed generates a centrifugal force sufficient to cause the end 23 of the rod 11 to contact the metal strips 12.

As the depth of insertion of the slidable member 8 into the housing 1 is increased the amount the spring 9 must be compressed to permit the end 23 of rod 11 to contact the metal strips 12 decreases, thus decreasing the swing speed required to energize the buzzer 15. The slidable member 8 can be graduated along its length with numerical values to provide some indication of the swing speed required to energize the buzzer 15.

Figure 4:
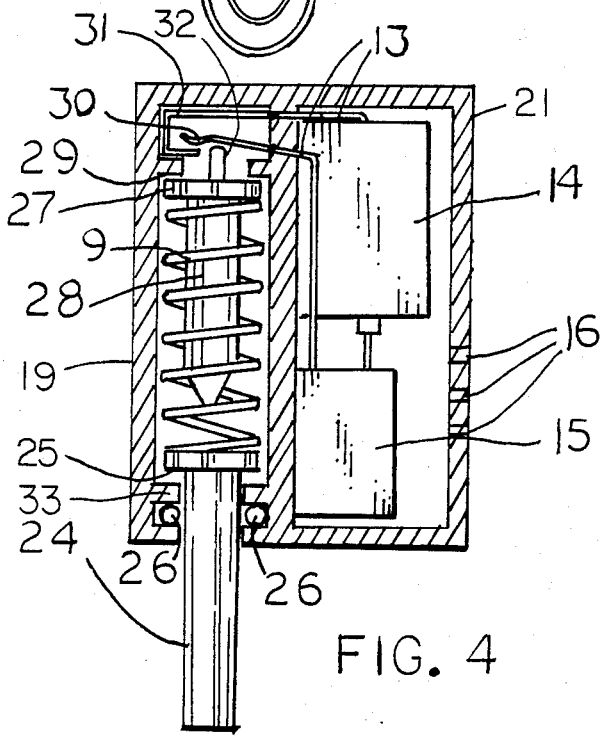
FIG. 4 is a sectional view of the device showing an alternate version of the device of FIG. 2.

Turning now to FIG. 4, there is shown a sectional view of an alternate embodiment of the instant invention wherein like reference numerals identify identical components. In the alternate embodiment, a slidable member 24 having an integral cap 25 extends into the first section 19 of housing 1. The integral cap 25 provides a support for the helical spring 9. As in the previously described embodiment, the spring 9 surrounds a rod or plunger 28 having an integral cap 27, which rests on the top of the spring 9 to support the rod 28 within the spring. The cap 27 also includes a finger 32 extending therefrom. The spring 9 is sized so that when the device 2 is not being subjected to any external forces, the cap 27 of the rod 28 will abut the lip 29 in the first section 19 of the housing 1. In such a condition, the finger 32 prevents a pre-stressed conducting element or switch-blade 30 from contacting the conducting element 31.

When the club is swung, the centrifugal force generated by the swing will cause the rod 28 and finger 32 to move toward the slidable member 24 against the force of the spring 9. Simultaneously, the pre-stressed conducting element 30 will relax to approach the conducting element 31. When the club 5 is swung with a sufficient speed, the rod 28 and finger 32 will move a sufficient distance to allow contact between the conducting elements 30 and 31, thus closing the circuit and causing the audible signal to be emitted. The greater the initial compression of spring 9 by slidable member 24, the greater the force required to further compress the spring to allow contact between the conducting members 30 and 31. Thus, the speed at which the club must be swung to cause the device to emit the audible signal can be varied. To ensure that the position of the slidable member is maintained, the slidable member 24 is provided with a tightly fitting O-ring 26 which is secured to the first section 19 of the housing 1 adjacent the opening through which the slidable member extends. In the illustrated embodiment, the O-ring 26 is held in place by the lip 33. The O-ring 26 is sufficiently sized so that while it will permit the slidable member 24 to move therethrough, any undesired movement is prevented.

In use, the device 2 emits a sound which persists as long as the golfer's swing is of a sufficient speed to create a centrifugal force equal to or greater than that which can close the battery-buzzer circuit. As previously noted, in a properly executed swing the club head 7 will increase in speed as it approaches the ball, reaching a maximum speed at the ball. With good swing momentum and shift of body weight at ball impact, a high swing speed will be maintained through at least a foot or two of club head travel past impact into the follow through. The device 2 will indicate this type of performance by the sound first being emitted just as the head 7 strikes the ball, then continuing into the follow through.

A poor swing is generally characterized by increasing swing speed too quickly in the earlier part of the down swing. This reduces the speed that club head 7 would otherwise achieve through the impact zone. Such a swing would give a short burst of sound before impact or no sound at all. Another characteristic of a poorly executed swing is that maximum club head speed is not sustained past the impact zone into the follow through. In such a case, the sound would not be heard after ball impact.

While the preferred embodiments have been described in connection with a golf club, it is apparent that this device can be advantageously used in connection with other sports such as tennis or baseball, where a racket, bat, or the like is used to strike a ball.

I claim:

1. A golf club swing training device comprising the combination of a golf club and an attachment therefor, said attachment comprising, housing means attachable to said shaft, electrically operated means within said housing actuated by centrifugal force generated by swinging the club, said electrically operated means having audbile signal emitting means for emitting a continuous audible signal for as long as the club speed achieved during the swing generates a centrifugal force equal to or greater than a predetermined minimum, the housing attachment means being positionable on the club shaft approximately at the swing weight point on the club as determined by a swing weight machine such that there is no substantial change in the swing weight of the club with the device attached.

2. The combination of claim 1 in which the audible signal emitting means further comprises means for varying the amount of centrifugal force needed to cause the audible signal emitting means to emit the audible signal.

3. The combination of claim 1 in which the audible signal emitting means comprises a circuit having a power source, buzzer and switch, and resilient means biased to force the switch open and responsive to the centrifugal force generated by swinging the club so that when the centrifugal force is equal to or greater than the predetermined minimum, the switch will close against the force of the resilient means to close the circuit and activate the buzzer for as long as the centrifugal force exceeds the predetermined minimum.

* * * * *